US009286836B2

(12) United States Patent
Ikenishi

(10) Patent No.: US 9,286,836 B2
(45) Date of Patent: Mar. 15, 2016

(54) IMAGE PROCESSING METHOD, IMAGE OUTPUT APPARATUS, AND DISPLAY APPARATUS

(71) Applicant: CANON KABUSHIKI KAISHA, Tokyo (JP)

(72) Inventor: Shunsuke Ikenishi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/201,961

(22) Filed: Mar. 10, 2014

(65) Prior Publication Data

US 2014/0267454 A1 Sep. 18, 2014

(30) Foreign Application Priority Data

Mar. 14, 2013 (JP) ..... 2013-051952

(51) Int. Cl.

*G09G 5/10* (2006.01)
*G09G 3/34* (2006.01)
*G09G 3/36* (2006.01)

(52) U.S. Cl.

CPC ..... *G09G 3/3406* (2013.01); *G09G 3/3611* (2013.01); *G09G 5/10* (2013.01); *G09G 2320/0646* (2013.01); *G09G 2320/0666* (2013.01); *G09G 2340/06* (2013.01)

(58) Field of Classification Search

CPC ..... G09G 5/10; G09G 3/36; G06F 15/00
USPC ..... 345/690, 691; 358/1.9
See application file for complete search history.

(56) References Cited

U.S. PATENT DOCUMENTS

2007/0236713 A1* 10/2007 Ishiguchi ..... 358/1.9
2010/0321414 A1* 12/2010 Muroi et al. ..... 345/690
2011/0115836 A1* 5/2011 Wan et al. ..... 345/691
2011/0122171 A1* 5/2011 Kwon et al. ..... 345/690
2011/0249039 A1* 10/2011 Ogi et al. ..... 345/690

FOREIGN PATENT DOCUMENTS

JP 2005-192019 A 7/2005
JP 2007-312057 A 11/2007

* cited by examiner

*Primary Examiner* — Nicholas Lee
*Assistant Examiner* — Abdul-Samad A Adediran
(74) *Attorney, Agent, or Firm* — Fitzpatrick, Cella, Harper & Scinto

(57) ABSTRACT

An image processing method applies color conversion to an input image and outputs the image. The method includes the steps of: acquiring profile information concerning display characteristics of a display apparatus including a backlight unit, a control unit configured to control a light emission amount of the backlight unit, and a display panel configured to modulate light from the backlight unit, the display characteristics being changed according to the light emission amount of the backlight unit; color converting the input image into an image in a color space of the display apparatus by using the acquired profile information in the acquiring; and outputting the image being subjected to the color conversion.

18 Claims, 18 Drawing Sheets

| INPUT | | | OUTPUT | | |
|---|---|---|---|---|---|
| R | G | B | X | Y | Z |
| 0 | 0 | 0 | 0.1 | 0.1 | 0.1 |
| ~ | | | ~ | | |
| 3 | 3 | 3 | 0.2 | 0.2 | 0.2 |
| ~ | | | ~ | | |
| 128 | 128 | 128 | 40 | 40 | 40 |

*Fig.6A*

| INPUT | | | OUTPUT | | |
|---|---|---|---|---|---|
| X | Y | Z | R | G | B |
| 0.1 | 0.1 | 0.1 | 0 | 0 | 0 |
| ~ | | | ~ | | |
| 0.2 | 0.2 | 0.2 | 0 | 0 | 0 |
| ~ | | | ~ | | |
| 40 | 40 | 40 | 128 | 128 | 128 |

*Fig.6B*

| INPUT | | | OUTPUT | | |
|---|---|---|---|---|---|
| R | G | B | X | Y | Z |
| 0 | 0 | 0 | 0.2 | 0.2 | 0.2 |
| ~ | | | ~ | | |
| 128 | 128 | 128 | 40 | 40 | 40 |

*Fig.6C*

| | x | y | Lv |
|---|---|---|---|
| R | 0.64 | 0.33 | |
| G | 0.32 | 0.60 | |
| B | 0.15 | 0.68 | |
| W | 0.34 | 0.36 | 80cd/m$^2$ |
| Bk | 0.33 | 0.33 | 0.2cd/m$^2$ |

*Fig.8A*

| | x | y | Lv |
|---|---|---|---|
| R | 0.65 | 0.34 | |
| G | 0.32 | 0.61 | |
| B | 0.15 | 0.68 | |
| W | 0.34 | 0.36 | 80cd/m$^2$ |
| Bk | 0.30 | 0.31 | 0.1cd/m$^2$ |

*Fig.8B*

| | x | y | Lv |
|---|---|---|---|
| R | 0.65 | 0.34 | |
| G | 0.32 | 0.62 | |
| B | 0.15 | 0.68 | |
| W | 0.34 | 0.36 | 80cd/m$^2$ |
| Bk | 0.29 | 0.31 | 0.05cd/m$^2$ |

*Fig.8C*

| INPUT | | | OUTPUT | | |
|---|---|---|---|---|---|
| X | Y | Z | R | G | B |
| 0.1 | 0.1 | 0.1 | 0 | 0 | 0 |
| ~ | | | ~ | | |
| 0.2 | 0.2 | 0.2 | 5 | 5 | 5 |
| ~ | | | ~ | | |
| 40 | 40 | 40 | 128 | 128 | 128 |

*Fig.9A*

| INPUT | | | OUTPUT | | |
|---|---|---|---|---|---|
| R | G | B | X | Y | Z |
| 0 | 0 | 0 | 0.1 | 0.1 | 0.1 |
| ~ | | | ~ | | |
| 5 | 5 | 5 | 0.2 | 0.2 | 0.2 |
| ~ | | | ~ | | |
| 128 | 128 | 128 | 40 | 40 | 40 |

*Fig.9B*

IMAGE PROCESSING METHOD, IMAGE OUTPUT APPARATUS, AND DISPLAY APPARATUS

BACKGROUND OF THE INVENTION

1. Field of the Invention

The present invention relates to an image processing method, an image output apparatus, and a display apparatus for executing color management processing using display characteristic information of an image display apparatus.

2. Description of the Related Art

There is a technique called color management for performing matching of colors by converting colors among different devices in a digital camera, a monitor, a printer, and the like into united colors and processing the colors. In the color management, colors are converted into device dependent colors (RGB or CMYK) or device independent colors (CIE-XYZ or CIE-L*a*b*) and matched. The device dependent colors represent colors that are different, depending on the devices on which they are displayed. Therefore, for example, even if RGB values are the same, colors of an image photographed by a certain digital camera and the colors displayed when the same RGB values are input to a monitor are different. The device independent colors are indexes of united colors not depending on the devices on which they are displayed. For example, colors having the same CIE-XYZ values look the same when viewed on the monitor and in an image photographed by the digital camera. In color management, according to correspondence relation information of device dependent colors of an input device and device independent colors, the device dependent colors of the input device are converted into the device independent colors. According to correspondence relation information of device dependent colors of an output device and device independent colors, the device independent colors are converted into the device dependent colors of the output device. Consequently, the output device can output colors the same as the colors of the input device. The common device independent colors at this point are referred to as profile connection space (PCS). Conventionally, as a technique for executing color management processing using correspondence relation information of device dependent colors and device independent colors, a technique for converting colors on the basis of one kind of correspondence relation information determined for each of devices is generally used.

Japanese Patent Application Laid-Open No. 2005-192019 discloses that a matrix coefficient of applied color conversion is changed on the basis of a brightness component value of an input image. However, in the technique of Japanese Patent Application Laid-Open No. 2005-192019, correspondence relation information of devices is one kind of information. The same conversion is performed concerning the same signal irrespective of a state of an image display apparatus.

There is a technique for, even when display characteristics of an image display apparatus such as setting of a color gamut and γ of the image display apparatus are different, expressing colors in a form matching characteristics of the image display apparatus at that point. For example, Japanese Patent Application Laid-Open No. 2007-312057 discloses that a change in parameters inside an image display apparatus is detected and profiles are switched.

On the other hand, as a technique of obtaining high quality images for a monitor, dimming control for adjusting a backlight light amount is examined. In a monitor that makes use of a liquid crystal panel, usually, light of a backlight is irradiated from the back of the liquid crystal panel and transmitted through the liquid crystal panel to express colors. There is a limit in reducing the transmittance of liquid crystal. Therefore, in some cases, even if the transmittance of the liquid crystal is minimized, the light of the backlight is transmitted and sufficient contrast cannot be obtained. On the other hand, there is known a technique for improving contrast by performing dimming control for adjusting a backlight light amount according to an image signal.

As the dimming control, there are global dimming for uniformly changing a light amount of the entire backlight and local dimming for dividing the backlight into several control regions (hereinafter LD regions) and changing a light amount independently for each of the divided LD regions.

SUMMARY OF THE INVENTION

When the color management of the related art is applied to an image display apparatus in which the dimming control for changing display characteristics according to an input image is performed, colors of an image cannot be correctly displayed on the image display apparatus. This is because, since display characteristics of the image display apparatus used for the color management and actual display characteristics of the image display apparatus are different, conversion processing by the color management cannot be correctly performed.

Therefore, the present invention provides an image display system, an image display apparatus, and a control method for the image display apparatus that can display an image in correct colors even when display characteristics of the image display apparatus change according to an input image.

According to a first aspect of the present invention, there is provided an image processing method for applying color conversion to an input image and outputting the image. This image processing method includes the steps of: acquiring profile information concerning display characteristics of a display apparatus including a backlight unit, a control unit configured to control a light emission amount of the backlight unit, and a display panel configured to modulate light from the backlight unit, the display characteristics being changed according to the light emission amount of the backlight unit; color converting the input image into an image in a color space of the display apparatus using the acquired profile information in the acquiring; and outputting the image being subjected to the color conversion in the color converting.

According to a second aspect of the present invention, there is provided an image output apparatus that applies color conversion to an input image and outputs the image. This image output apparatus includes: an acquiring unit configured to acquire profile information concerning display characteristics of a display apparatus including a backlight unit, a control unit configured to control a light emission amount of the backlight unit, and a display panel configured to modulate light from the backlight unit, the display characteristics being changed according to the light emission amount of the backlight unit; a converting unit configured to apply to the input image color conversion to convert the input image into an image in a color space of the display apparatus using the profile information acquired by the acquiring unit; and an output unit configured to output the image being subjected to the color conversion by the converting unit.

According to a third aspect of the present invention, there is provided a display apparatus including a backlight unit, a control unit configured to control a light emission amount of the backlight unit, and a display panel configured to modulate light from the backlight unit, display characteristics being changed according to the light emission amount of the backlight unit. The display apparatus includes: an acquiring unit configured to acquire profile information concerning the display characteristics of the display apparatus; a converting unit configured to apply to the input image color conversion to convert the input image into an image in a color space of the display apparatus using the profile information acquired by the acquiring unit; and an output unit configured to output the image being subjected to the color conversion by the converting unit to the display panel.

According to the present invention, it is possible to display an image in correct colors even when display characteristics of an image display apparatus change according to an input image.

Further features of the present invention will become apparent from the following description of exemplary embodiments with reference to the attached drawings.

BRIEF DESCRIPTION OF THE DRAWINGS

FIGS. 6A to 6C are examples of profiles of an image and profiles of the image display apparatus;

FIGS. 8A to 8C are examples of display characteristics of the image display apparatus in the case of dimming ON and OFF;

FIGS. 9A and 9B are examples of profiles of the image display apparatus in dimming ON;

DESCRIPTION OF THE EMBODIMENTS

First Embodiment

Embodiments of the present invention are explained below with reference to the drawings. However, the present invention is not limited to the embodiments and can be carried out in various forms without departing from the spirit of the present invention.

In a first embodiment, an image display system adapted to an image display apparatus that performs global dimming is explained. In this embodiment, it is assumed that an image signal is formed by 8 bits (0 to 255) of each of RGB. However, the present invention is not limited to this and can be applied to various signals.

In the explanation, CIE-XYZ is used as PCS. However, even in CIE-L*a*b* and other color systems, the same processing can be performed after converting the CIE-L*a*b* and other color systems into the CIE-XYZ.

Figure 1A:
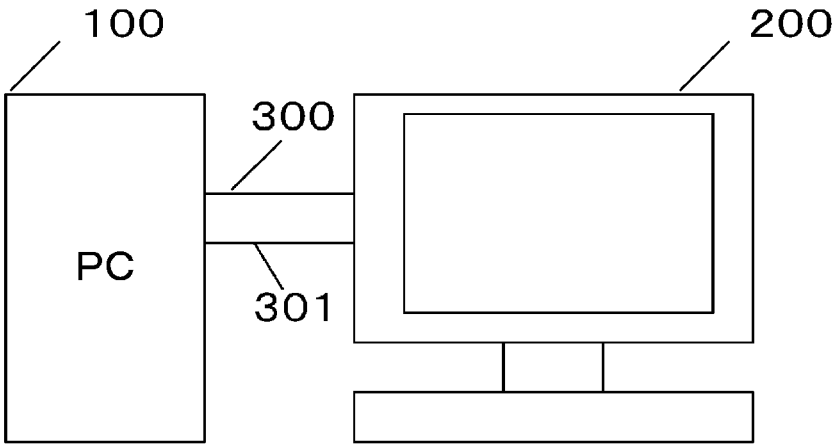
FIGS. 1A and 1B are schematic diagrams of first to third embodiments.

FIG. 1A is a schematic diagram of an image display system applied with the present invention. The image display system mainly includes an image output apparatus 100 and an image display apparatus 200. An image output from the image output apparatus 100 is input to the image display apparatus 200 through a digital visual interface (DVI) cable 300 and displayed. Information can be exchanged between the image output apparatus 100 and the image display apparatus 200 through a Universal Serial Bus (USB) cable 301. In an example explained in this embodiment, the image output apparatus 100 and the image display apparatus 200 are connected by the DVI cable. However, the present invention is not limited to this. In the example explained in this embodiment, a cable for exchanging information between the image output apparatus 100 and the image display apparatus 200 is the USB cable. However, the present invention is not limited to this.

Figure 2:
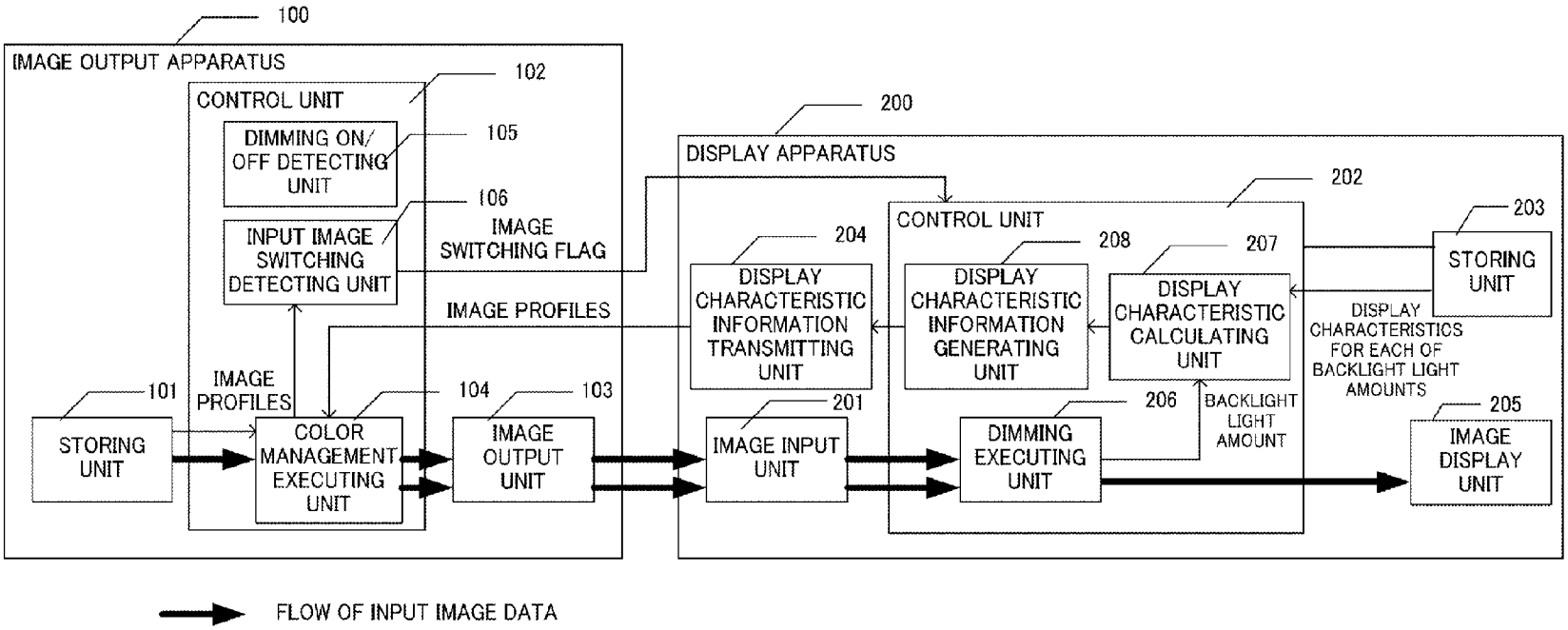
FIG. 2 is a functional block diagram of an image display system according to the first and second embodiments.

FIG. 2 is a functional block diagram of the image display system applied with the present invention. The image output apparatus 100 includes a storing unit 101, a control unit 102, and an image output unit 103. The control unit 102 includes a color management executing unit 104, a dimming ON/OFF detecting unit 105, and an input image switching detecting unit 106. The image display apparatus 200 includes an image input unit 201, a control unit 202, a storing unit 203, a display characteristic information transmitting unit 204, and an image display unit 205. The control unit 202 includes a dimming executing unit 206, a display characteristic calculating unit 207, and a display characteristic information generating unit 208.

Figure 3:
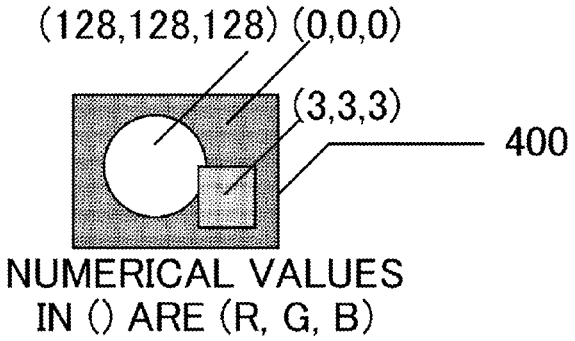
FIG. 3 is an image example displayed in the first and second embodiments.

Functions of the blocks are explained. Image files are stored in the storing unit 101. The image files are, for example, image files of Tagged Image File Format (TIFF), Joint Photographic Experts Group (JPEG), and Portable Document Format (PDF). An image 400 is shown in FIG. 3 as an example of an image. An International Color Consortium (ICC) profile, in which a correspondence relation between device dependent colors (hereinafter, image RGB) and device independent colors (hereinafter, XYZ) of an image is described, is embedded in an image file. In general, a color space of AdobeRGB or sRGB (standard RGB) is often used. If information concerning XYZ values corresponding to all combinations of RGB values is given to profiles, the size of the profiles is extremely large. Therefore, two forms, i.e., a profile of a matrix format and a profile of a look-up table (LUT) format are used.

The profile of the matrix format is a profile in which chromaticities at points of R(255, 0, 0), G(0, 255, 0), and B (0, 0, 255), γ curves of RGB, brightnesses and color gamuts of W(255, 255, 255) and Bk(0, 0, 0), and the like are described. The profile of the LUT format is a profile in which XYZ values corresponding to combinations of lattice points of uniform RGB values such as 0, 32, 64, 96, 128, 160, 192, 224, and 255 and RGB values corresponding to uniform combinations of the XYZ values are described. Both the formats do not include information concerning conversion values from the RGB values into the XYZ values and conversion values from the XYZ values to the RGB values of all the combinations. Therefore, information included in the profiles are calculated by interpolation to obtain the conversion values from the RGB values into the XYZ values and conversion values from the XYZ values into the RGB values of all the combinations.

Profiles of the AdobeRGB and the sRGB are defined by a standard. Therefore, even if the ICC profiles are not embedded in an image file, in some cases, conversion is possible if it is described in header information or the like of the image file that a profile is the AdobeRGB or the sRGB. In that case, conversion from the RGB values into the XYZ values is performed with reference to profile information of the AdobeRGB or the sRGB stored in the storing unit 101 of the image output apparatus 100. An ICC profile indicating display characteristics of the image display apparatus 200 in a dimming OFF state is recorded in the storing unit 101.

The ICC profile of the image display apparatus 200 is created and stored during factory shipment of the image display apparatus 200 or during calibration execution of the image display apparatus 200. The calibration of the image display apparatus 200 means processing for calibrating a color displayed by the image display apparatus 200 using a not-shown colorimeter. The ICC profile of the image display apparatus 200 describes a relation between input RGB of the image display apparatus 200 and a display characteristic (CIE-XYZ) in display of the input RGB. Like the profiles of an image, there are a profile of the matrix format and a profile of the LUT format.

An image display viewer application is mounted on the control unit 102. The image display viewer application reads out an image and an ICC profile from the storing unit 101 on the basis of an image display instruction from a user and instructs the color management executing unit 104 to perform color management processing designating the ICC profile and the image. The color management executing unit 104 executes the color management processing on image data on the basis of profiles of the image and profiles of the image display apparatus 200. As the profiles of the image display apparatus 200, profiles in a dimming OFF state stored in the storing unit 101 or profiles corresponding to an emitted light amount of a backlight (a backlight light amount), which is changed by dimming, transmitted from the image display apparatus 200 are used.

The dimming ON/OFF detecting unit 105 detects an ON/OFF state of dimming of the image display apparatus 200. The dimming ON/OFF detecting unit 105 transmits a dimming state check command to the image display apparatus 200 through, for example, the USB cable 301 and detects the ON/OFF state of the dimming on the basis of dimming ON/OFF information returned from the image display apparatus 200. The input image switching detecting unit 106 sets an image switching flag to ON/OFF on the basis of image switching information received from the color management executing unit 104. When detecting image switching, the input image switching detecting unit 106 sends image switching flag ON/OFF information to the image display apparatus 200.

The dimming executing unit 206 acquires a statistical amount for an input image and determines a backlight light amount from the statistical amount. The dimming executing unit 206 determines the extension width (a correction amount) of a signal according to the backlight light amount. The statistical amount is, for example, a maximum signal level of an entire screen. As the backlight light amount, a backlight light amount during dimming OFF is represented as 100%.

[Math. 1]

$$\left(\frac{\text{Maximum signal level}}{255}\right)^{\gamma\ \text{value of the image display apparatus}} \times 100(\%) \qquad \text{(Expression 1)}$$

When the backlight light amount is equal to or lower than 20%, the backlight is controlled to set the backlight light amount to 20%. Extension (correction) processing for the signal is performed such that the following expression holds.

[Math. 2]

$$\text{Signal level after extension} = \text{Signal level before extension} \times \left(\frac{100(\%)}{\textit{Backligh ligh}\ \text{amount}(\%)}\right)^{\left(\frac{1}{\gamma\ \text{value of the image display apparatus}}\right)} \qquad \text{(Expression 2)}$$

When the image switching flag is erected, the dimming executing unit 206 does not perform the extension processing for the signal, determines only the backlight light amount, and sends the backlight light amount to the display characteristic calculating unit 207. When the image switching flag is not erected, the dimming executing unit 206 sets the backlight light amount to a backlight light amount calculated last time, performs the extension processing for the signal on the basis of Expression 2 using the backlight light amount, and sends an image being subjected to the extension processing to the image display unit 205.

The display characteristic calculating unit 207 reads out display characteristics of the image display apparatus 200 corresponding to the backlight light amount from the storing unit 203. The display characteristic calculating unit 207 sends the read-out display characteristics to the display characteristic information generating unit 208. The display characteristic information generating unit 208 creates an ICC profile of the image display apparatus 200 corresponding to display characteristic information sent from the display characteristic calculating unit 207. The display characteristic information transmitting unit 204 receives the ICC profile from the display characteristic information generating unit 208 and transmits the ICC profile to the color management executing unit 104 through the USB cable 301.

Figure 4:
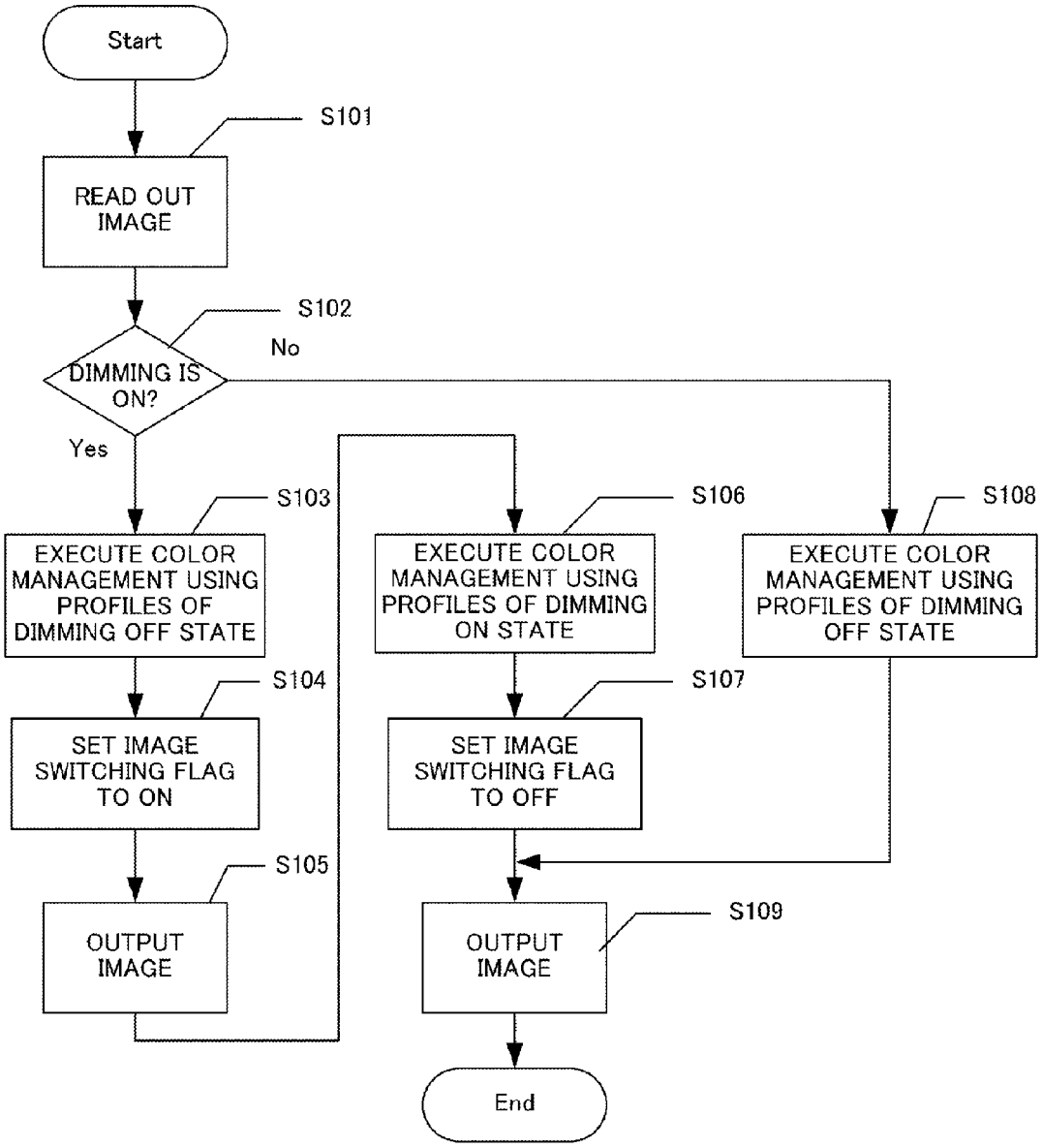
FIG. 4 is a flowchart for explaining a flow of the operation of an image output apparatus according to the first embodiment.
Figure 5:
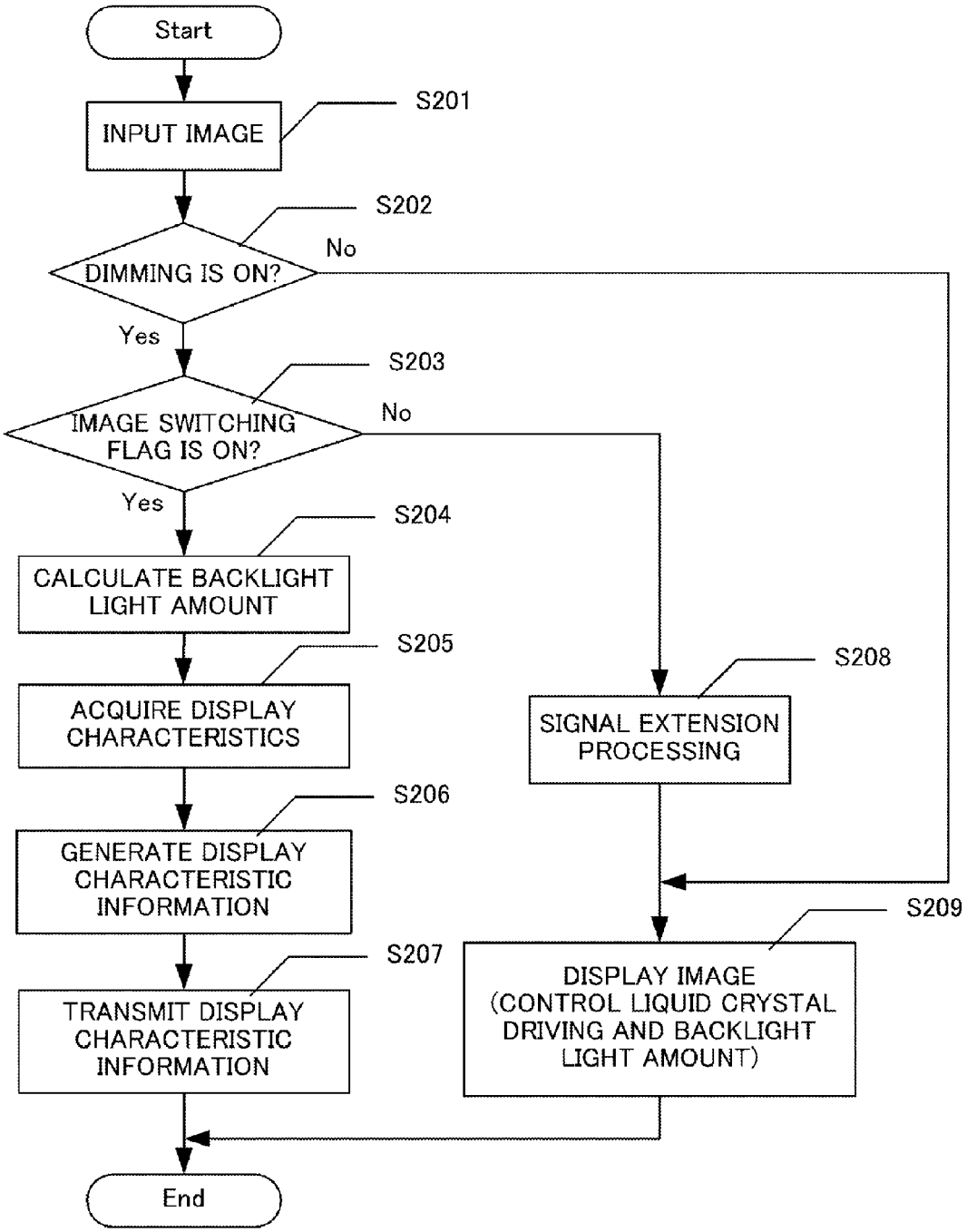
FIG. 5 is a flowchart for explaining a flow of the operation of an image display apparatus according to the first embodiment.

A flow of processing by the image output apparatus 100 in displaying the image 400 stored in the storing unit 101 of the image output apparatus 100 on the image display apparatus 200 is explained according to a flowchart of FIG. 4. A flow of processing by the image display apparatus 200 is explained according to a flowchart of FIG. 5. The processing of the flowchart of FIG. 4 is started at a point when the user instructs the image display viewer application to display an image. The processing of the flowchart of FIG. 5 is started in every vertical synchronization period with respect to an input image signal.

First, color management processing performed when the dimming is OFF is explained.

The flow of the processing by the image output apparatus 100 is explained with reference to FIG. 4. In S101, the control unit 102 of the image output apparatus 100 reads out a TIFF image file from the storing unit 101, extracts an ICC profile of an image and image data from the TIFF image file, and sends the ICC profile and the image data to the color management executing unit 104. The control unit 102 reads out an ICC profile representing the display characteristics of the image display apparatus 200 in a dimming OFF state from the storing unit 101 and sends the ICC profile to the color management executing unit 104.

In S102, the control unit 102 instructs the dimming ON/OFF detecting unit 105 to detect whether the image display apparatus 200 is in a dimming ON state or the dimming OFF state. When the dimming is OFF, the processing proceeds to S108. In S108, the color management executing unit 104 applies the color management processing to the image data on the basis of the ICC profile attached to the image data and the ICC profile of the image display apparatus 200 in the dimming OFF state. In S109, the image output unit 103 outputs the image data being subjected to the color management processing to the image display apparatus 200.

The flow of the processing by the image display apparatus 200 is explained with reference to FIG. 5. In S201, the image input unit 201 of the image display apparatus 200 receives image data. In S202, since the dimming is OFF, the dimming executing unit 206 performs normal control for setting a backlight light amount fixed (a maximum light emission amount (100%)) irrespective of an input image. In this case, the processing proceeds to S209. The image display unit 205 drives liquid crystal at input RGB values, performs backlight control with the backlight light amount in the dimming OFF to modulate backlight light, and displays an image on a panel. The display of the image being subjected to the color management processing during the dimming OFF is performed as explained above.

Figure 7:
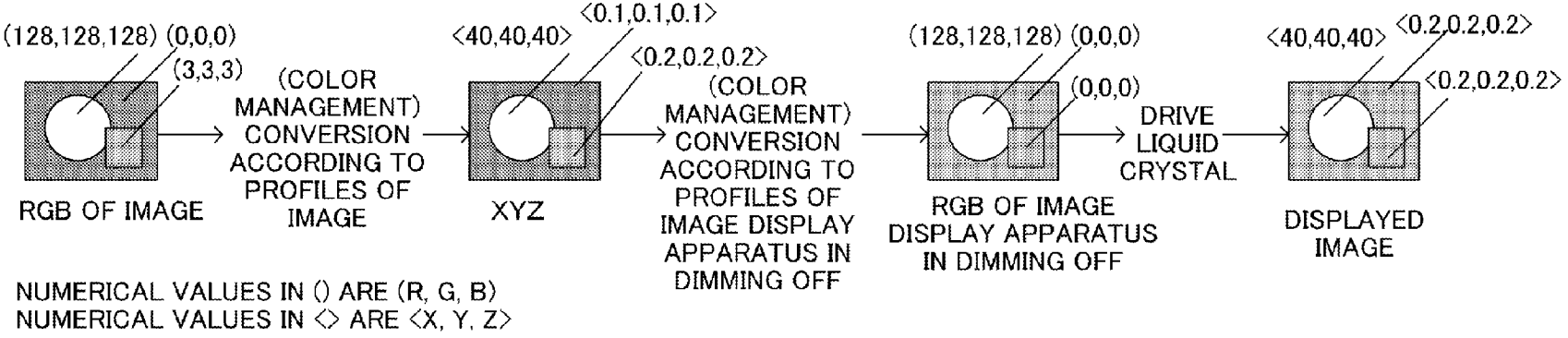
FIG. 7 is a diagram showing a flow of conversion of image data in the case of dimming OFF in the first embodiment.

A relation between image RGB and XYZ calculated by interpolation from profiles of an image is shown in FIG. 6A. A relation between RGB and XYZ calculated by interpolation from profiles of the image display apparatus 200 in the dimming OFF is shown in FIG. 6B. An example in which the image 400 shown in FIG. 3 is converted on the basis of these relations is shown in FIG. 7. In FIG. 6B, both (R, G, B) values of (X, Y, Z)=(0.1, 0.1, 0.1) and (X, Y, Z)=(0.2, 0.2, 0.2) coincide with each other in (0, 0, 0). This is because the image display apparatus 200 cannot implement darker display than the display implemented on the basis of the above condition, without performing the dimming.

RGB values of image data are converted into XYZ values on the basis of the relation shown in FIG. 6A. The XYZ values are converted into the RGB values of the image display apparatus 200 on the basis of the relation shown in FIG. 6B. The liquid crystal of the image display apparatus 200 is driven with the RGB values. In the display characteristics of the image display apparatus 200, the input and the output in FIG. 6B are interchanged with each other. The image display apparatus 200 has a relation shown in FIG. 6C. An image based on the image data can be displayed in original colors in the image display apparatus 200 according to the color management processing explained above. However, because of floating black, a portion darker than black of the image display apparatus 200 cannot be correctly displayed in the original colors. For example, a portion of image RGB=(0, 0, 0) cannot be correctly displayed in the original colors.

As explained above, in some cases, a dark portion cannot be correctly expressed in the original colors unless the dimming is performed. The color management processing performed in the case of dimming ON, which is characteristic processing of the present invention, is explained.

When the dimming is ON, since a backlight light amount changes, even if the extension processing for a signal is performed, brightness, chromaticity, color gamut, and the like of Bk change and a color of an output image with respect to an input signal changes. Examples of display characteristics in a backlight light amount of 50% at the time of the dimming OFF and the dimming ON are respectively shown in FIGS. 8A and 8B. Because of a difference in the display characteristics, if the color management processing is performed making use of the display characteristics in a state of the dimming OFF, conversion from XYZ values into RGB values of the image display apparatus 200 cannot be performed on the basis of the display characteristics in the dimming ON state. Colors displayed on the image display apparatus 200 are different from original colors of an image.

Figure 17:
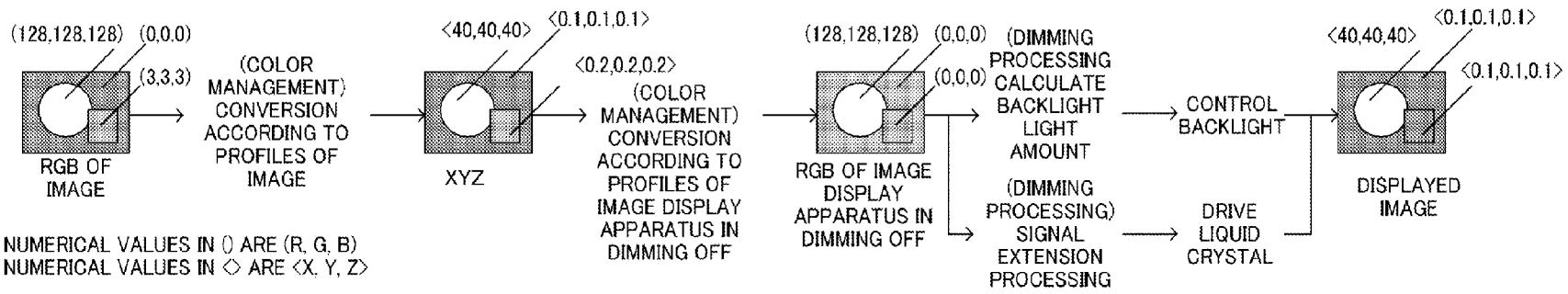
FIG. 17 is a diagram showing a flow of conversion of image data in the case of dimming ON in the past.

The display characteristics of the image display apparatus 200 in the dimming ON state (the backlight light amount of 50%) are shown in FIGS. 9A and 9B. A reference example in which the image 400 shown in FIG. 3 is converted when the color management processing of the present invention is not performed in the dimming ON state is shown in FIG. 17. RGB values input to the image display apparatus 200 are the same as the RGB values in the case of the dimming OFF. In the dimming ON, dimming processing is applied to this image data. An image is displayed according to the display characteristics during the dimming ON (FIG. 9B). Therefore, as shown in FIG. 17, displayed colors are different from original colors of the image. This is because, since conversion from XYZ into RGB of the image display apparatus 200 is performed according to the display characteristics in the dimming OFF but conversion from input RGB into output XYZ is performed according to the display characteristics in the dimming ON in the image display apparatus 200, the two kinds of conversion do not match.

A flow of the color management processing in the case of the dimming ON in this embodiment is explained. First, a flow of processing by the image output apparatus 100 is explained with reference to FIG. 4. When an ON/OFF detection result of the dimming is ON in S102, the processing proceeds to S103. In S103, the color management executing unit 104 applies the color management processing to image data according to profiles of an image and predetermined profiles (profiles in the dimming OFF state) of the image display apparatus 200. In S104, the input image switching detecting unit 106 sets the image switching flag to ON and transmits image switching flag information to the image display apparatus 200.

In S105, the image output unit 103 outputs the image data being subjected to the color management processing to the image display apparatus 200. In S106, the color management executing unit 104 executes the color management processing for the image data same as the image data in S103 using the profiles of the image and profiles in the dimming ON state. The profiles in the dimming ON state used here are profiles calculated by the image display apparatus 200 on the basis of the image data output in S105 and transmitted from the image display apparatus 200. Therefore, when the processing reaches S106 before the profiles are sent to the color management executing unit 104, the color management executing unit 104 waits for execution of S106 until the profiles are sent from the image display apparatus 200.

In S107, the input image switching detecting unit 106 sets the image switching flag to OFF and transmits image switching flag information to the image display apparatus 200. In S109, the image output unit 103 outputs the image data being subjected to the color management processing to the image display apparatus 200.

A flow of processing by the image display apparatus 200 is explained with reference to FIG. 5. In S201, the image input unit 201 of the image display apparatus 200 receives the image data output by the image output apparatus 100 in S105. Since the dimming is ON in S202, dimming control for changing a backlight light amount according to an input image is performed. In this case, the processing proceeds to S203. Since the image switching flag is ON, the processing proceeds to S204. In S204, the dimming executing unit 206 determines a backlight light amount from the input image and transmits the backlight light amount to the display characteristic calculating unit 207.

In S205, the display characteristic calculating unit 207 acquires information concerning display characteristics corresponding to the transmitted backlight light amount from the storing unit 203 and transmits the information to the display characteristic information generating unit 208. In S206, the display characteristic information generating unit 208 creates an ICC profile on the basis of the information concerning the display characteristics transmitted from the display characteristic calculating unit 207 and sends the ICC profile to the display characteristic information transmitting unit 204. In S207, the display characteristic information transmitting unit 204 transmits the ICC profile to the color management executing unit 104 of the image output apparatus 100 through the USB cable 301.

The processing returns to S201. In S201, the image input unit 201 of the image display apparatus 200 receives the image data output by the image output apparatus 100 in S109. Since the dimming is ON in S202, the processing proceeds to S203. Since the image switching flag is OFF, the processing proceeds to S208. In S208, the dimming executing unit 206 performs signal extension processing according to Expression 2 on the basis of the backlight light amount determined in S204 and sends an image signal to the image display unit 205. In S209, the image display unit 205 drives the liquid crystal with the signal being subjected to the extension processing and performs backlight control such that the backlight has the backlight light amount determined in S204. Consequently, an image is displayed on the display panel.

Figure 10:
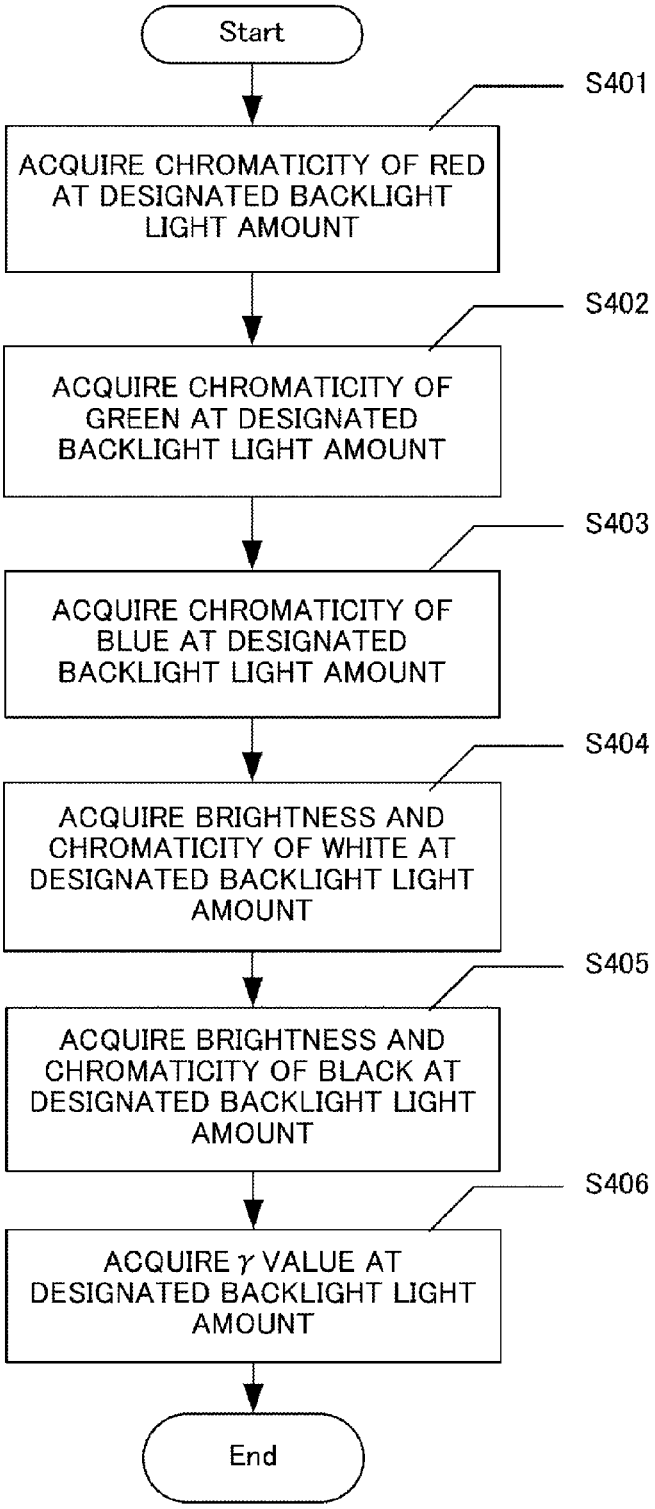
FIG. 10 is a flowchart for explaining a flow of the operation of a display characteristic calculating unit in the first and second embodiments.

Calculation processing for display characteristics in S205 is explained with reference to a flowchart of FIG. 10. In S401, the display characteristic calculating unit 207 acquires, from the storing unit 203, the chromaticity of red corresponding to the backlight light amount determined by the dimming executing unit 206. Similarly, in S402, the display characteristic calculating unit 207 acquires the chromaticity of green. In S403, the display characteristic calculating unit 207 acquires the chromaticity of blue. In S404, the display characteristic calculating unit 207 acquires, from the storing unit 203, the brightness and the chromaticity of white corresponding to the backlight light amount determined by the dimming executing unit 206. Similarly, in S405, the display characteristic calculating unit 207 acquires the brightness and the chromaticity of black. In S406, the display characteristic calculating unit 207 acquires, from the storing unit 203, a γ value corresponding to the backlight light amount determined by the dimming executing unit 206.

As explained above, the color management processing is performed on the basis of the display characteristic of the image display apparatus changed by the dimming. Consequently, it is possible to correctly display original colors of an image.

Figure 11:
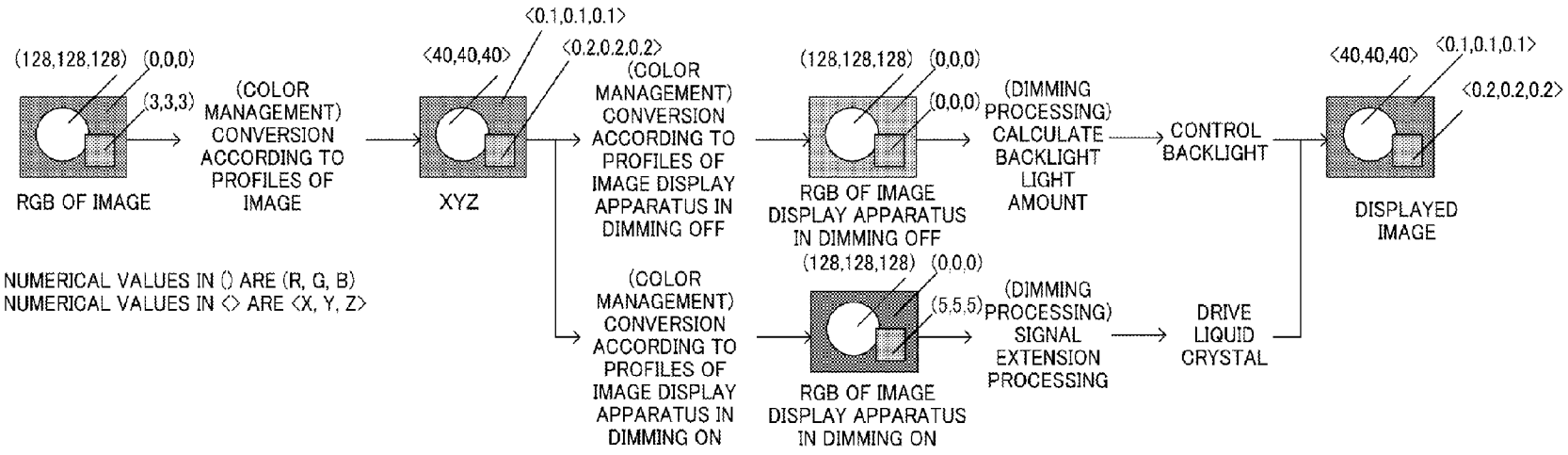
FIG. 11 is a diagram showing a flow of conversion of image data in the case of dimming ON in the first embodiment.

In an example shown in FIG. 11, the image 400 shown in FIG. 3 is converted when the color management processing in this embodiment is performed with the display characteristics of the image display apparatus 200 in the dimming ON state (the backlight light amount of 50%) set as shown in FIGS. 9A and 9B. Concerning RGB values input to the image display apparatus 200, a backlight light amount is determined in the same manner as the determination during the dimming OFF. Consequently, the backlight light amount is determined as 50%. The color management processing is applied to image data according to the display characteristics (FIG. 9A) as that point. After the dimming processing (the signal extension processing) is applied to the image data, an image is displayed on the display panel. Display characteristics of the display are as shown in FIG. 9B. In the display characteristics, an input and an output of the display characteristics shown in FIG. 9A are interchanged with each other. Therefore, it is possible to display original colors of the image.

In this embodiment, a flow of processing in displaying a still image is explained. However, the present invention is not limited to this and can also be applied when a moving image is displayed. For example, processing same as the processing explained above only has to be performed every time a backlight light amount is switched according to the dimming control in a scene change or the like in the moving image.

In the above explanation, the display characteristics at the respective backlight light amounts are stored in the storing unit 203. However, even if the display characteristics are not stored, display characteristics at the respective backlight light amounts may be calculated from display characteristics at specific backlight light amounts, for example, display characteristics at a maximum backlight light amount and display characteristics at a minimum backlight light amount. As a calculation method, a method explained below can be illustrated.

For example, it is assumed that display characteristics (XYZ values corresponding to respective RGB) at a maximum backlight light amount (100%) and display characteristics (XYZ values corresponding to (0, 0, 0)) of black (signal (0, 0, 0)) at a minimum backlight light amount (20%) are stored in the storing unit 101. In this case, when XYZ values corresponding to RGB values at a backlight light amount (x %) are represented as XYZ (R, G, B, x), display characteristics (XYZ values) at a certain backlight light amount (a %) can be estimated by the following expression.

[Math. 3]

$$XYZ(R, G, B, a) = XYZ(R, G, B, 100) - XYZ(0, 0, 0, 100) + \{XYZ(0, 0, 0, 100) - XYZ(0, 0, 0, 20)\} * \frac{a - 20}{100 - 20} + XYZ(0, 0, 0, 20) \quad \text{(Expression 3)}$$

Figure 12:
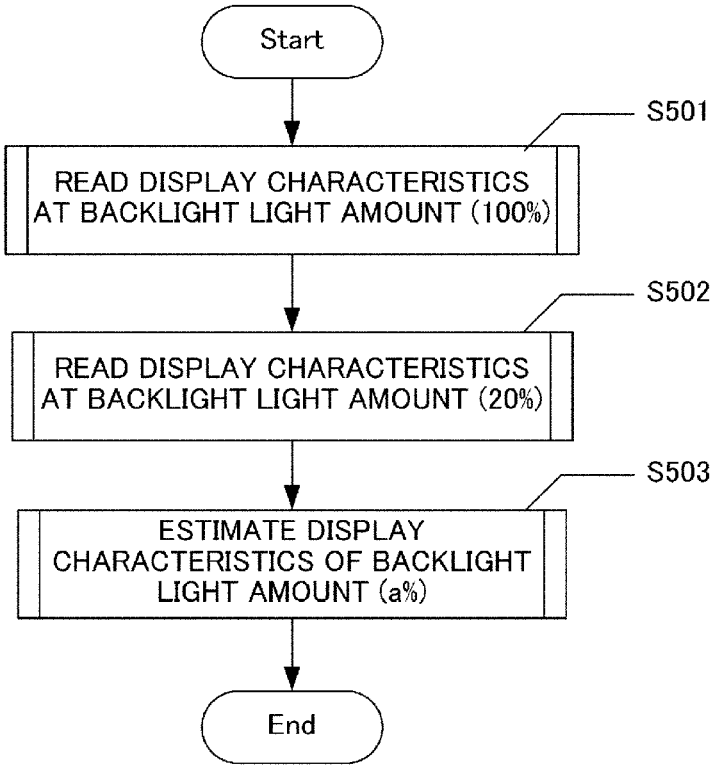
FIG. 12 is a flowchart in which the display characteristic calculating unit in the first and second embodiments estimates display characteristics.

A flowchart of processing for estimating the display characteristics (the XYZ values) at the backlight light amount (a %) is as shown in FIG. 12. In S501, the display characteristic calculating unit 207 acquires display characteristics at a backlight light amount of 100% from the storing unit 203. In S502, the display characteristic calculating unit 207 acquires display characteristics at a backlight light amount of 20% from the storing unit 203. In S503, the display characteristic calculating unit 207 estimates, according to Expression 3, display characteristics corresponding to the backlight light amount (a %) determined by the dimming.

When display characteristic information is represented in a 3DLUT format, display characteristics in the 3DLUT format at the backlight light amount (a %) is calculated by the expression for each of lattice points of the display characteristic information.

In the example explained in the dimming processing in S208, the backlight light amount calculation result in S204 is used. This is because, if a backlight light amount is calculated again and a backlight light amount different from the backlight light amount calculation result in S204 is obtained, display characteristics are different. However, all display characteristics for each of backlight light amounts may be acquired. The color management processing may be performed taking into account changing display characteristics as well.

In the example explained in this embodiment, the color management executing unit 104 is provided in the image output apparatus 100. However, the image display apparatus 200 may include the color management executing unit 104. In that case, the image output apparatus 100 does not execute the color management processing. The image display apparatus 200 receives image data and profiles of an image and performs the color management processing.

Second Embodiment

In an example explained in a second embodiment, the image display apparatus 200 performs local dimming. In the second embodiment, differences from the first embodiment are mainly explained.

Figure 13:
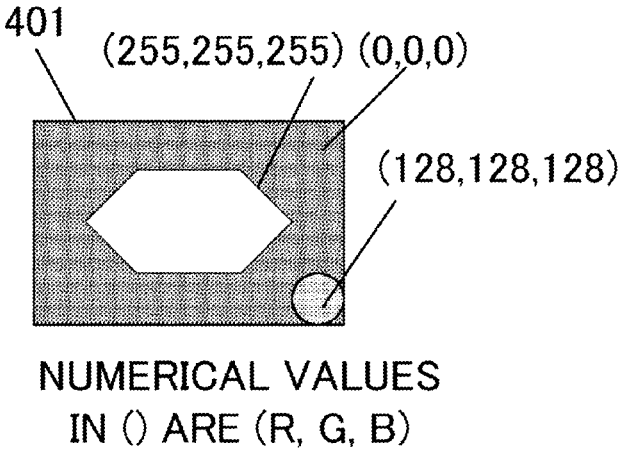
FIG. 13 is an image example displayed in the first and second embodiments.

When an image 401 shown in FIG. 13 is displayed by the global dimming, since a signal level 255 is present in an image, a backlight light amount is 100% according to the calculation of Expression 1 and is the same as the backlight light amount obtained when the dimming is not performed. Therefore, because of floating black, a portion darker than black of the image display apparatus cannot be displayed in original colors.

Figure 14:
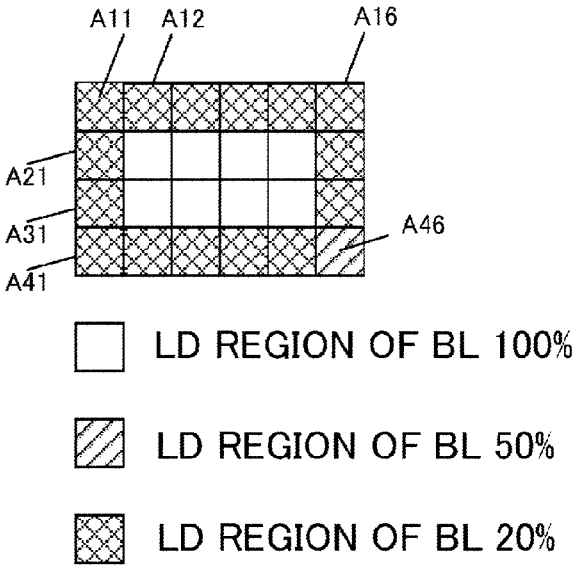
FIG. 14 is a diagram for explaining an LD region of an image display apparatus according to the second embodiment.
Figure 15:
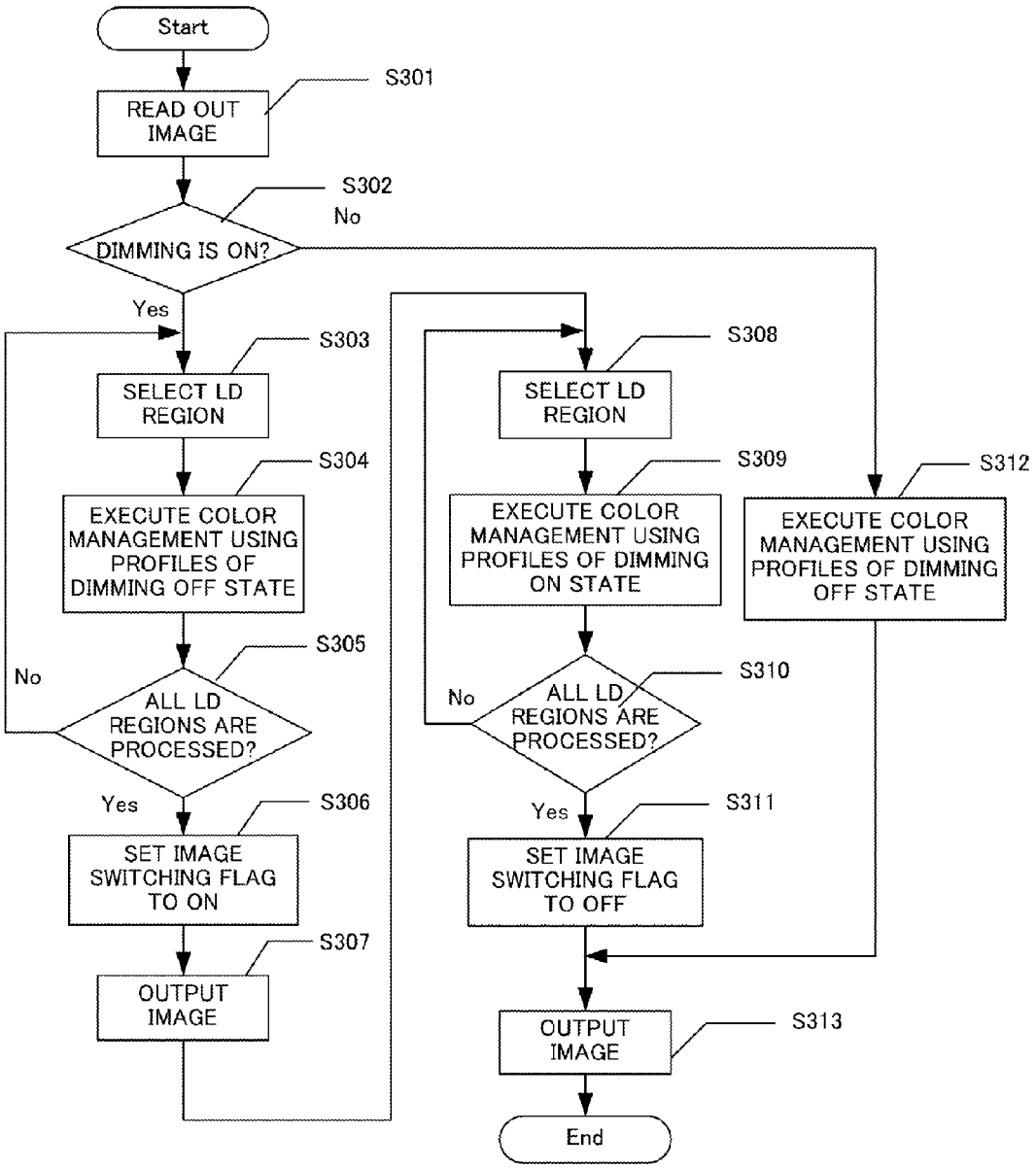
FIG. 15 is a flowchart for explaining a flow of the operation of an image output apparatus according to the second embodiment.
Figure 16:
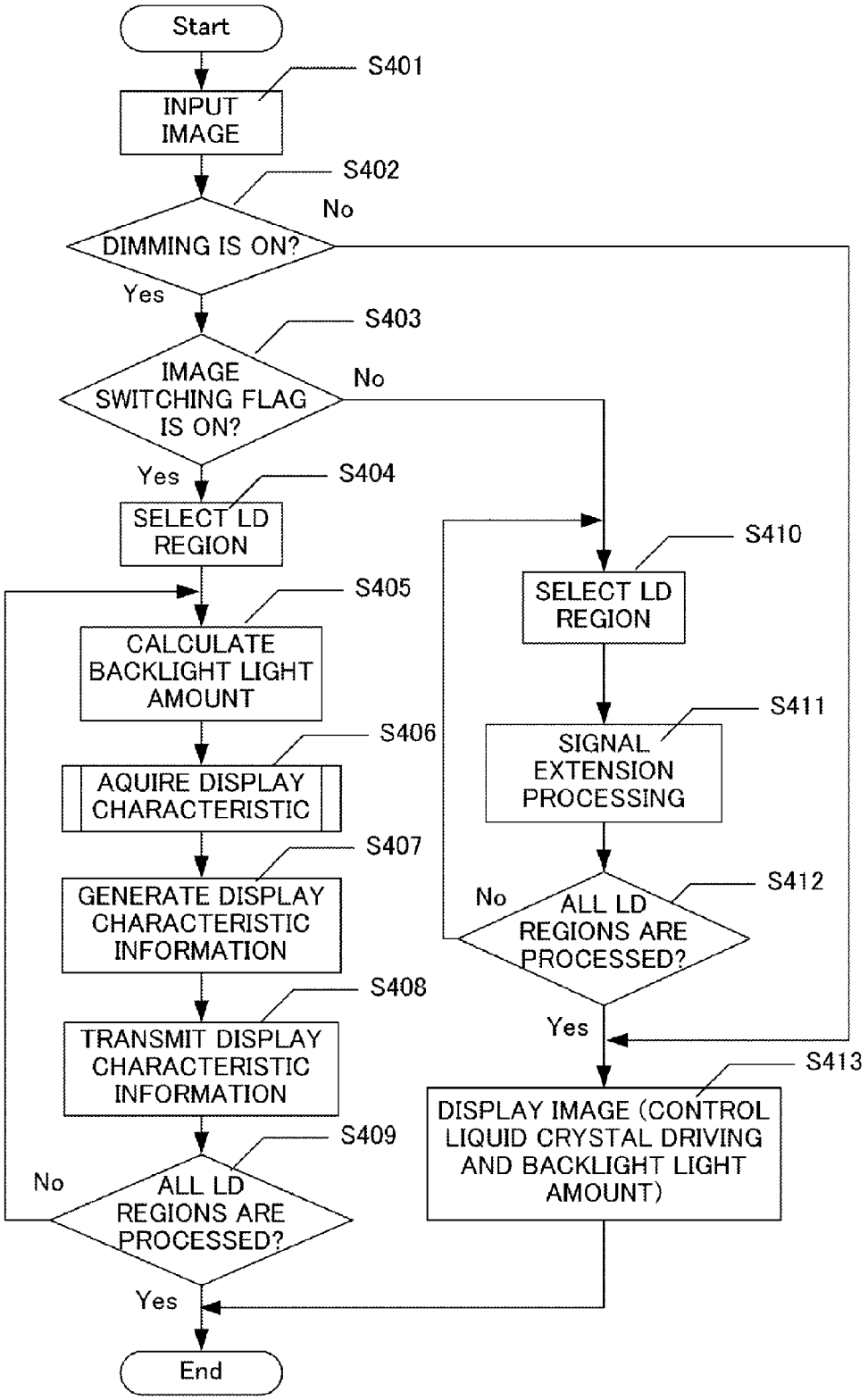
FIG. 16 is a flowchart for explaining a flow of the operation of the image display apparatus according to the second embodiment.

In the second embodiment, the backlight of the image display unit 205 includes a plurality of light emitting regions. A light emission amount is controlled independently for each of the light emitting regions. The light emitting region is hereinafter referred to as LD region. LD regions in the case of the local dimming are shown in FIG. 14. A11, A12, and the like in FIG. 14 are respectively the LD regions. A backlight light amount can be controlled independently for each of the LD regions. A flowchart of processing by the image output apparatus 100 in the case of the local dimming is shown in FIG. 15. A flowchart of processing by the image display apparatus 200 in the case of the local dimming is shown in FIG. 16. A difference from the global dimming is explained. In S303, the control unit 102 selects one processing target LD region. In S304, the color management executing unit 104 executes the color management processing in the case of the dimming OFF on the LD region. In S305, the control unit 102 determines whether the processing of all the LD regions ends. If the processing for all the LD regions does not end, the control unit 102 returns to S303 and repeats the processing. If the processing for all the LD regions ends, the control unit 102 proceeds to processing in S306 and performs processing for setting the image switching flag to ON as in the case of the global dimming.

The selection of the LD region in S303 is performed in order, for example, from a region at the screen upper left to a region at the lower right (A11⇒ A12⇒ . . . ⇒ A16⇒ A21 ⇒ A46). Color management processing in the case of dimming ON in S309, calculation of a backlight light amount and creation of an ICC profile corresponding to the backlight light amount in S405 to S408, and signal extension processing in S411 are also performed for each of the LD regions. Consequently, the local dimming is performed. When the image 401 shown in FIG. 13 is displayed, according to calculation by Expression 1 in the respective LD regions, as shown in FIG. 14, a backlight light amount in the A11 region and the like is calculated as 20%, a backlight light amount in the A22 region and the like is calculated as 100%, and a backlight light amount in the A46 region is calculated as 50%. Image data in image regions corresponding to the LD regions is subjected to the color management processing on the basis of display characteristics corresponding to the respective backlight light amounts (in the case of 20%, the display characteristics shown in FIG. 8C, in the case of 50%, the display characteristics shown in FIG. 8B, and in the case of 100%, the display characteristics shown in FIG. 8A).

Consequently, in the case of the local dimming, as in the case of the global dimming, the LD regions are subjected to the color management processing on the basis of the display characteristics corresponding to the respective backlight light amounts. Therefore, it is possible to display an image in correct colors.

In the example explained above, the display characteristics are calculated and the color management processing is performed in order from the LD region at the upper left in the right direction. However, the calculation of display characteristics and the color management processing may be performed in other order. For example, display characteristics may be converted in order from the LD region in which a change in the display characteristics due to a difference in a backlight light amount is large, that is, the LD region in which the backlight light amount is small. An image may be output at a point when time required for the conversion exceeds a certain threshold. Consequently, it is possible to reduce a delay in display. In that case, since the conversion is already performed in the region where the change in the backlight light amount is large, it is possible to minimize an influence due to the delay in the conversion.

Third Embodiment

In the examples explained in the first and second embodiments, the image output apparatus 100 and the image display apparatus 200 are the separate apparatuses. However, in a third embodiment, an image display apparatus in which the functions of the image output apparatus 100 and the image display apparatus 200 are integrated is explained.

Figure 1B:
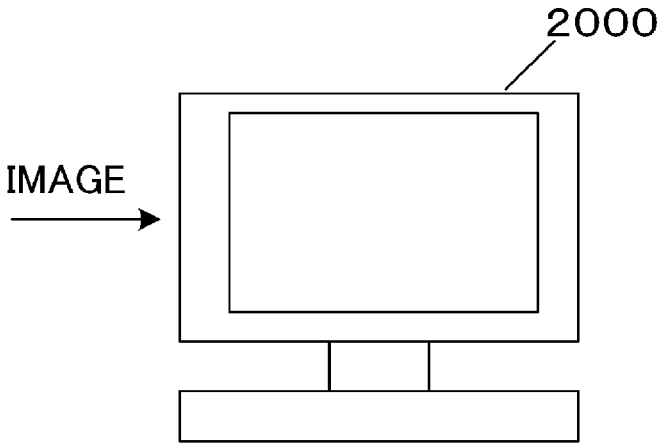
Figure 18:
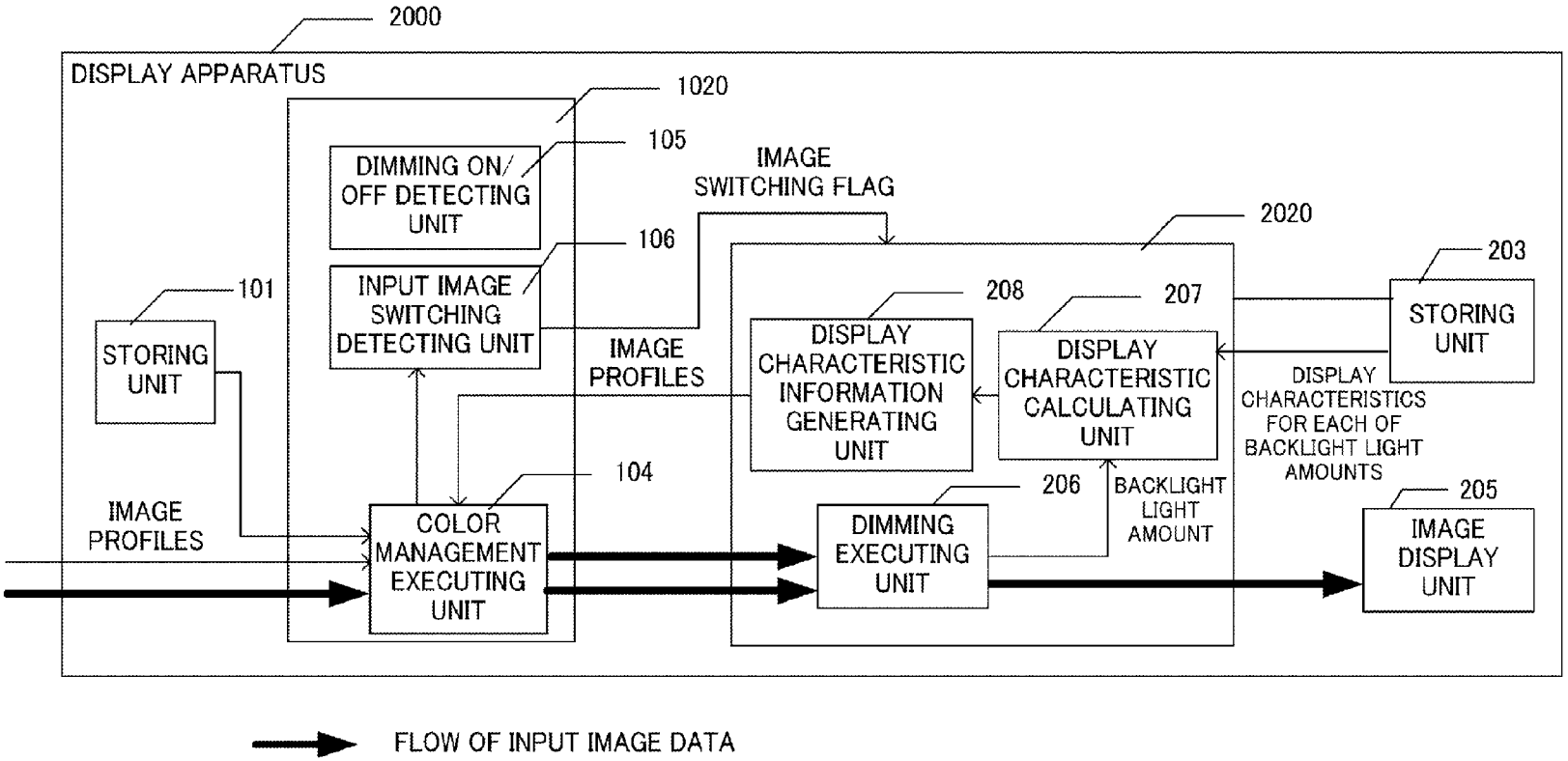
FIG. 18 is a functional block diagram of an image display apparatus according to the third embodiment.

FIG. 1B is a diagram showing the schematic configuration of an image display apparatus 2000 according to the third embodiment. The image display apparatus 2000 receives an input of image data from the outside and displays an image based on the input image data. FIG. 18 is a schematic functional block diagram of the image display apparatus 2000 according to the third embodiment. Blocks that perform processing equivalent to the processing by the blocks explained in the first and second embodiments are denoted by the same reference numerals and signs and represented by the same names. Detailed explanation of the blocks is omitted. As shown in FIG. 18, in the third embodiment, the image display apparatus 2000 itself includes the main functional blocks of the image output apparatus 100 in the first and second embodiments. A color management control unit 1020 configured to perform color management processing includes a function equivalent to the control unit 102 of the image output apparatus 100 in the first and second embodiments. A dimming control unit 2020 configured to perform dimming control includes a function equivalent to the control unit 202 of the image display apparatus 200 in the first and second embodiments.

The image display apparatus 2000 in the third embodiment can receive an input of image profiles together with image data and perform the color management processing on the basis of the image profiles. As in the first and second embodiments, the image display apparatus 2000 can also acquire profile information from the storing unit 101 and perform the color management processing on the basis of the profile information. An output from the color management executing unit 104 is input to the dimming executing unit 206. An output from the display characteristic information generating unit 208 is input to the color management executing unit 104. In the first and second embodiments, communication of information and image data between the image output apparatus 100 and the image display apparatus 200 is performed via a USB cable or an image cable. However, in the third embodiment, since the image display apparatus 2000 has the integrated configuration, the communication is performed via a signal line on the inside.

In the configuration in the third embodiment, first, image data input to the image display apparatus 2000 is converted on the basis of profiles in dimming OFF. A backlight light amount in dimming control is determined on the basis of the converted image data. Profiles in dimming ON corresponding to the determined backlight light amount are acquired. The image data is converted on the basis of the profiles. Display control is performed on the basis of the converted image data. That is, extension processing corresponding to the backlight light amount is applied to the converted image data. A liquid crystal panel is driven on the basis of the image data being subjected to the extension processing. Light emission control for the backlight is performed according to the determined backlight light amount. Consequently, improvement of reproducibility of black by the dimming control is attained. Improvement of reproducibility of original colors of an image is also attained according to color management processing adapted to fluctuation in monitor profiles due to the dimming control.

As explained above, in the third embodiment, both of the control of a backlight light amount corresponding to an image and the color management processing corresponding to the backlight light amount are executed inside the image display apparatus 2000. In the image display apparatus 2000 in the third embodiment, as in the first and second embodiments, the global dimming and the local dimming are possible.

In the configuration explained in the third embodiment, image data is input from the outside. However, the image display apparatus 2000 may have a configuration in which a tuner configured to receive a digital broadcast is provided, a broadcast wave is input from the outside, the tuner generates image data, and the image data is input to the color management executing unit 104. As a reception method for the image data from the outside, an image signal from an image signal output apparatus such as a DVD player may be received or an image file on a memory card may be read via a card reader I/F.

According to the third embodiment, in the image display apparatus that performs the dimming control corresponding to input image data, the color management processing is performed using image display apparatus profiles corresponding to a backlight light amount. Therefore, even when display characteristics are different depending on a backlight light amount, it is possible to accurately perform display with original colors of an image.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-051952, filed on Mar. 14, 2013, which is hereby incorporated by reference herein in its entirety.

What is claimed is:

1. An image processing method for applying color conversion to an input image and outputting the image to which the color conversion is applied, the image processing having a plurality of steps, the method comprising the steps, of: acquiring profile information concerning display characteristics of a display apparatus including a backlight unit, a control unit configured to control a light emission amount of the backlight unit, and a display panel configured to modulate light from the backlight unit, wherein the display characteristics are changed according to the light emission amount of the backlight unit;

color converting the input image into an image in a color space of the display apparatus using the acquired profile information acquired in the acquiring step;

outputting the image subjected to the color conversion in the color converting step; and reading out, from a storing unit, first profile information concerning display characteristics of the display apparatus corresponding to a first light emission amount of the backlight unit and second profile information concerning display characteristics of the display apparatus corresponding to a second light emission amount different from the first light emission amount, and generating, using the first profile information and the second profile information, third profile information concerning display characteristics of the display apparatus corresponding to a light emission amount determined on the basis of the input image, wherein in the acquiring step, the third profile information generated in the generating step is acquired.

2. The image processing method according to claim 1, wherein, in the color converting step, color conversion from a color space of the input image into a device independent color space is applied to the input image, and color conversion from the device independent color space into the color space of the display apparatus is performed using the profile information acquired in the acquiring step.

3. The image processing method according to claim 1, further comprising the step of determining a light emission amount of the backlight unit on the basis of the input image.

4. The image processing method according to claim 3, wherein, in the determining step, profile information concerning display characteristics of the display apparatus corresponding to a predetermined light emission amount of the backlight unit is acquired, color conversion is applied to the input image using the acquired profile information, and a light emission amount of the backlight unit is determined on the basis of the image being subjected to the color conversion.

5. The image processing method according to claim 4, wherein the control unit is configured to execute a dimming ON control operation in which the light emission amount of the backlight unit is adjusted according to the input image and a dimming OFF control operation in which the light emission amount of the backlight unit is fixed irrespective of the input image, and the predetermined light emission amount is a light emission amount in a case where the dimming OFF control operation is executed.

6. The image processing method according to claim 4, wherein the predetermined light emission amount is a maximum light emission amount of the backlight unit.

7. The image processing method according to claim 1, wherein the backlight unit is formed of a plurality of light emitting regions in which a light emission amount can be independently controlled, and in the acquiring step, profile information concerning display characteristics of the display apparatus that change according to a light emission amount of each of the light emitting regions is acquired in the acquiring step.

8. The image processing method according to claim 1, further comprising the step of detecting switching of the input image, wherein in the acquiring step, the profile information is acquired in response to the switching of the input image detected in the detecting step.

9. An image output apparatus that applies color conversion to an input image and outputs the image to which the color conversion is applied, the image output apparatus comprising:

a processor; and a memory coupled to the processor to store instructions that cause the processor to perform operations of:

an acquiring unit configured to acquire profile information concerning display characteristics of a display apparatus including a backlight unit, a control unit configured to control a light emission amount of the backlight unit, and a display panel configured to modulate light from the backlight unit, wherein the display characteristics are changed according to the light emission amount of the backlight unit;

a converting unit configured to apply to the input image a color conversion to convert the input image into an image in a color space of the display apparatus using the profile information acquired by the acquiring unit;

an output unit configured to output the image being subjected to the color conversion by the converting unit; and a generating unit configured to read out, from a storing unit, first profile information concerning display characteristics of the display apparatus corresponding to a first light emission amount of the backlight unit and second profile information concerning display characteristics of the display apparatus corresponding to a second light emission amount different from the first light emission amount and to generate, using the first profile information and the second profile information, third profile information concerning display characteristics of the display apparatus corresponding to a light emission amount determined on the basis of the input image, wherein the acquiring unit acquires the third profile information generated by the generating unit.

10. The image output apparatus according to claim 9, wherein the converting unit applies to the input image color conversion from a color space of the input image into a device independent color space and performs color conversion from the device independent color space into the color space of the display apparatus using the profile information acquired by the acquiring unit.

11. The image output apparatus according to claim 9, further comprising a determining unit configured to determine a light emission amount of the backlight unit on the basis of the input image.

12. The image output apparatus according to claim 11, wherein the determining unit acquires profile information concerning display characteristics of the display apparatus corresponding to a predetermined light emission amount of the backlight unit, applies color conversion to the input image using the acquired profile information, and determines a light emission amount of the backlight unit on the basis of the image being subjected to the color conversion.

13. A display apparatus comprising:

a backlight unit;

a processor; and a memory coupled to the processor to store instructions that cause the processor to perform operations of:

a control unit configured to control a light emission amount of the backlight unit;

a display panel configured to modulate light from the backlight unit, wherein display characteristics of said display apparatus are changed according to the light emission amount of the backlight unit;

an acquiring unit configured to acquire profile information concerning the display characteristics of said display apparatus;

a converting unit configured to apply to an input image color conversion to convert the input image into an image in a color space of the display apparatus using the profile information acquired by the acquiring unit;

an output unit configured to output the image being subjected to the color conversion by the converting unit to the display panel; and a generating unit configured to read out, from a storing unit, first profile information concerning display characteristics of the display apparatus corresponding to a first light emission amount of the backlight unit and second profile information concerning display characteristics of the display apparatus corresponding to a second light emission amount different from the first light emission amount and to generate, using the first profile information and the second profile information, third profile information concerning display characteristics of the display apparatus corresponding to a light emission amount determined on the basis of the input image, wherein the acquiring unit acquires the third profile information generated by the generating unit.

14. The display apparatus according to claim 13, wherein the converting unit applies to the input image color conversion from a color space of the input image into a device independent color space and performs color conversion from the device independent color space into the color space of the display apparatus using the profile information acquired by the acquiring unit.

15. The display apparatus according to claim 13, further comprising a determining unit configured to determine a light emission amount of the backlight unit on the basis of the input image.

16. The display apparatus according to claim 15, wherein the determining unit acquires profile information concerning display characteristics of the display apparatus corresponding to a predetermined light emission amount of the backlight unit, applies color conversion to the input image using the acquired profile information, and determines a light emission amount of the backlight unit on the basis of the image being subjected to the color conversion.

17. An image processing method for applying color conversion to an input image and outputting the image to which the color conversion is applied, the image processing having a plurality of steps, the method comprising the steps, of:

acquiring profile information concerning display characteristics of a display apparatus including a backlight unit, a control unit configured to control a light emission amount of the backlight unit, and a display panel configured to modulate light from the backlight unit, wherein the display characteristics are changed according to the light emission amount of the backlight unit;

color converting the input image into an image in a color space of the display apparatus using the acquired profile information in the acquiring step;

outputting the image being subjected to the color conversion in the color converting step; and detecting switching of the input image, wherein in the acquiring step, the profile information is acquired in response to the switching of the input image detected in the detecting step.

18. A display apparatus for modulating light from a backlight unit with a display panel, controlling a light emission amount of a backlight unit, and changing display characteristics according to the light emission amount of the backlight unit, the display apparatus comprising:

a processor; and a memory coupled to the processor to store instructions that cause the processor to perform operations of:

an acquiring unit configured to acquire profile information concerning the display characteristics of the display apparatus;

a converting unit configured to apply to an input image color conversion to convert the input image into an image in a color space of the display apparatus using the profile information acquired by the acquiring unit;

an output unit configured to output the image subjected to the color conversion by the converting unit to the display panel; and a detecting unit configured to detect switching of the input image, wherein the acquiring unit acquires the profile information in response to the switching of the input image detected by the detecting unit.

* * * * *